US006123438A

United States Patent [19]

Hentz

[11] Patent Number: 6,123,438

[45] Date of Patent: Sep. 26, 2000

[54] INSULATION SHIELD FOR RECESSED DOWNLIGHTING FIXTURES

[75] Inventor: Joseph A. Hentz, Crawfordsville, Ind.

[73] Assignee: NSI Enterprises, Inc., Atlanta, Ga.

[21] Appl. No.: 09/139,284

[22] Filed: Aug. 24, 1998

[51] Int. Cl.[7] ..... F21L 19/00

[52] U.S. Cl. ..... 362/373; 362/366; 362/148; 362/294; 362/364

[58] Field of Search ..... 362/366, 365, 362/364, 147, 148, 373, 150, 294

[56] References Cited

U.S. PATENT DOCUMENTS

| | | | |
|---|---|---|---|
| 4,910,651 | 3/1990 | Montanez | 362/148 |
| 5,374,812 | 12/1994 | Chan et al. | 362/364 |
| 5,662,414 | 9/1997 | Jening et al. | 362/366 |
| 5,707,143 | 1/1998 | Hentz | 362/365 |

*Primary Examiner*—Sandra O'Shea
*Assistant Examiner*—Ali Alavi
*Attorney, Agent, or Firm*—Kenneth E. Darnell

[57] ABSTRACT

A lighting fixture having an insulation shield mounted thereto for maintaining surrounding insulation a desired spacing from at least portions of the fixture to increase permissible lamp wattages in an insulation contact application, the shield is preferably formed of a polymeric material molded with openings to permit access to portions of the fixture such as a junction box. The insulation shield is particularly useful with downlighting fixtures installable immediately above ceiling openings, such fixtures typically being mounted to structural joists or to suspended ceilings, and especially downlighting fixtures where lighting performance is to be improved through use of higher wattage lamping. The insulation shield acts to provide a desired volume of air around the fixture in order to more effectively dissipate heat generated by the higher wattage lamping.

44 Claims, 8 Drawing Sheets

25
44
32
32
36
38
34

INSULATION SHIELD FOR RECESSED DOWNLIGHTING FIXTURES

DESCRIPTION OF THE PRIOR ART

1. Field of the Invention

The invention relates generally to an insulation shield for a lighting fixture which allows an increase in permissible lamp wattage by mounting insulation at a desired spacing from a lamp housing or can.

2. Background of the Invention

Lighting fixtures capable of being recessed into the ceiling of a structure are well known in both new construction and in retrofit situations due in part to the unobtrusive nature of the fixtures themselves and of the illumination provided by the fixtures. Recessed downlighting fixtures are generally referred to through use of the term "downlighting", this category of lighting providing a flexibility not available with most other categories of lighting due to the ability to employ a variety of fixtures capable of producing differing light levels in lighting situations which range from ambient to accent to wall washing and the like. When properly employed, downlighting can also be used in task lighting applications, the flexibility of downlighting not being limited in any use situation due in part to appearance considerations and the availability of a wide variety of differing lamping choices in most downlighting fixtures. Even though considerable choice is provided in the industry, improvement of the ability of particular downlighting fixtures to be utilized with a greater variety of lamping is a capability which has long been sought. With an ability to increase lamp wattages in a given downlighting fixture, lighting performance can be improved without modification of fixture components. An increase in lamp wattage, however, is inevitably accompanied by an increase in heat generated by a given fixture, it being necessary to dissipate this heat from the fixture so that a potential fire condition cannot develop. Applications where such considerations are of particular importance are "insulation contact" or I.C. applications where insulation effectively covers and contacts a fixture, the fixture being referred to as being "buried" in insulation. Such applications usually involve the mounting of a downlight fixture between joists which form structural members between a ceiling and the floor of vertically adjacent environmental spaces. Insulation is then caused to engage the fixture such as by the placement of insulation batts, the spraying of a foamable insulative material over the fixture and between the joists or by other known means in order to insulate the building structure. Such insulation in contact with heat-generating portions of the lighting fixture usually limit the lamp wattages useful within a given fixture since heat cannot be dissipated easily from a lighting fixture which is buried in insulation. Any improvement in the ability of a lighting fixture having an insulation contact rating to dissipate or accommodate heat generated by the fixture lamping improves the potential utility of the fixture due to an ability to provide increased lighting levels within the same application and with use of the same fixture. Costs, always a consideration in lighting choices, could be kept at a reasonable level through provision of an efficient modification of the fixture to allow use of higher wattage lamping especially if the components of the fixture itself would not require modification. Such lighting fixtures so configured must also be easily and rapidly installable not only by relatively skilled labor such as in new construction but also by relatively unskilled labor such as by a home owner in a retrofit situation. Fixtures capable of being improved by the present invention typically include a support element generally referred to as a "pan" which mounts a lamp housing or "can", a junction box and bar hangers among other elements. Lamping housed within the "can" is typically mounted by a socket mounted to a reflector trim which is mounted within the confines of the can. Portions of the reflector trim fit snuggly against a ceiling hole such that a gap does not exist between the trim and peripheral edge portions of the ceiling which surround the ceiling hole. Downlighting fixtures so configured are generally rated by the rating of the lamp housing or can as I.C. for "insulation contact" as noted above, as non-I.C. for "non-insulation contact", and as both non-I.C./I.C. when the housing or can can be employed in both applications. The ratings relate to the ability of the can and fixture to dissipate heat generated by lamping at a reasonable and safe rate.

The present invention particularly intends improvement to downlighting fixtures rated for I.C. and non-I.C./I.C. applications, a fixture so rated being capable of improved lighting performance, that is, light generation, in an I.C. application, this improved performance being possible by the ability of the fixture improved by the present invention to dissipate or accommodate heat generated by the higher wattage lamping necessary for providing increased light generation. The invention, a heat shield typically formed of polymeric material and mounted to a lighting fixture and covering at least portions of the lighting fixture to prevent contact with insulation and providing spacing of at least portions of the lighting fixture from insulation, causes the lighting fixture to become a "premium" I.C. fixture without modification to the components of the fixture itself. Thus, a given lighting fixture becomes more flexible in use, i.e., is usable in a greater number of use applications, by the simple mounting of a relatively inexpensive shield to the fixture so that fixture performance can be improved in I.C. applications. The invention thus provides improvement to existing lighting fixtures by allowing the use of lamping having increased wattage in insulation contact applications. Fixtures configured according to the invention can also be used in non-insulation contact applications.

SUMMARY OF THE INVENTION

The invention provides an insulation shield mountable to a lighting fixture, such as a downlighting fixture, which shield functions to increase the permissible lamp wattage which can be used particularly in an insulation contact (I.C.) application. In effect, the insulation shield of the invention converts an I.C. rated fixture or an I.C./non-I.C. fixture to a "premium" or "super" I.C. fixture which produces substantially more light in an I.C. application than would be possible if the fixture were used alone in an I.C. application without the shield of the invention. Without use of the present insulation shield, a given fixture in an I.C. application would only be able to use lamping of wattage below a certain permissible value, thereby causing the fixture to have a light output or lighting performance of a predetermined level. Use of the insulation shield of the invention increases lighting performance by allowing the given fixture to use lamping of increased wattage. Finishing trims useful in a fixture and rated for certain wattages can be rated for use with higher wattages when the present insulating shield is used with the fixture.

The insulation shield of the invention improves recessed lighting fixtures by permitting essentially the same fixture usable in a less demanding lighting performance application to be used as a "premium" fixture in an application demanding greater lighting performance without substantive alteration of the fixture except for the provision of high wattage lamping and the mounting to the fixture of the present insulation shield. The insulation shield of the invention can be utilized with lighting fixtures, particularly recessed downlighting fixtures,of differing size and of differing initial lighting performance. The insulation shield of the invention can be used with painted steel platforms or "pans" such as are conventional in the art or with wire frame pans such as are disclosed in U.S. Pat. No. 5,690,423, the disclosure of which is incorporated hereinto by reference, or the thermoplastic pan of U.S. Pat. No. 5,662,414, the disclosure of which is incorporated hereinto by reference. The insulation shield is readily mounted to such a lighting fixture and completely covers exterior portions of the lamp housing or "can" which is mounted by the pan of the lighting fixture, the insulation shield acting primarily to prevent contact of insulation surrounding the fixture with the lamp housing or can. Since lamping is mounted within the confines of such a can, it is the can which becomes heated to relatively high temperatures. Ordinary I.C. applications wherein insulation is allowed to contact the can are operable with lamping of a certain permissible wattage in order that the heat generated by the lamping can be accommodated to the degree necessary by heat dissipated from exterior surfaces of the can. The insulation shield of the invention maintains the insulation at desired spacings from the can and provides a volume of air within the shield which enables the can and thus the fixture to dissipate heat with efficiencies sufficient to allow the use of higher lamp wattages and to thus allow the fixture to produce higher illumination levels within an I.C. environment than would be possible without use of the insulation shield.

A junction box mounted to the pan of a lighting fixture improved by use of the insulation shield extends at least partially from the shield to allow access to the junction box through a rear hinged or snap-on cover and through knockouts as is conventional in the art. Bar hanger assemblies mountable to the pan of the lighting fixture are located either outside of the insulation shield or with portions of the bar hanger assemblies disposed interiorly of the shield with end portions thereof extending from the shield through aligned slots so that ends of the bar hanger assemblies can be utilized in a known manner to attach to joists or the like. Elements of the bar hanger assemblies slide relative to each other and relative to the pan of the fixture so that the bar hanger assemblies may be extended to a desired length for mounting between joists or the like at an appropriate spacing occasioned by a particular mounting situation. Bar hanger assemblies suitable for use with a fixture as disclosed herein are shown in U.S. Pat. No. 5,690,423 which is assigned to the assignee of the present application, the disclosure of the aforesaid patent being incorporated hereinto by reference.

Accordingly, it is a primary object of the invention to provide an insulation shield for a lighting fixture and particularly a recessed downlighting fixture to cause the fixture to be useful in an insulation contact application to produce increased lighting levels through the use of lamping of increased wattage.

It is another object of the invention to provide an insulation shield for mounting to a lighting fixture and particularly a recessed downlighting fixture, the shield preventing contact between at least portions of the lighting fixture and insulation in which the fixture is "buried" such that insulation contacts exterior surfaces of the insulation shield without contacting heated portions of the lighting fixture such as exterior surfaces of a lamp housing or can, the can being maintained within a predetermined volume of air suitable to facilitate dissipation of heat generated by lamping contained within the can.

It is yet another object of the invention to provide an inexpensive and lightweight insulation shield mountable to a lighting fixture and particularly a recessed downlighting fixture, the shield allowing access to portions of the lighting fixture required for installation and maintenance of the fixture while preventing contact between heated portions of the fixture and insulation so that heat can be efficiently dissipated from the fixture, the fixture thus being capable of producing improved lighting levels through use of lamping of increased wattage in I.C. installations.

Further objects and advantages of the invention will become more readily apparent in light of the following detailed description of the preferred embodiments.

DESCRIPTION OF THE PREFERRED EMBODIMENTS

Figure 1:
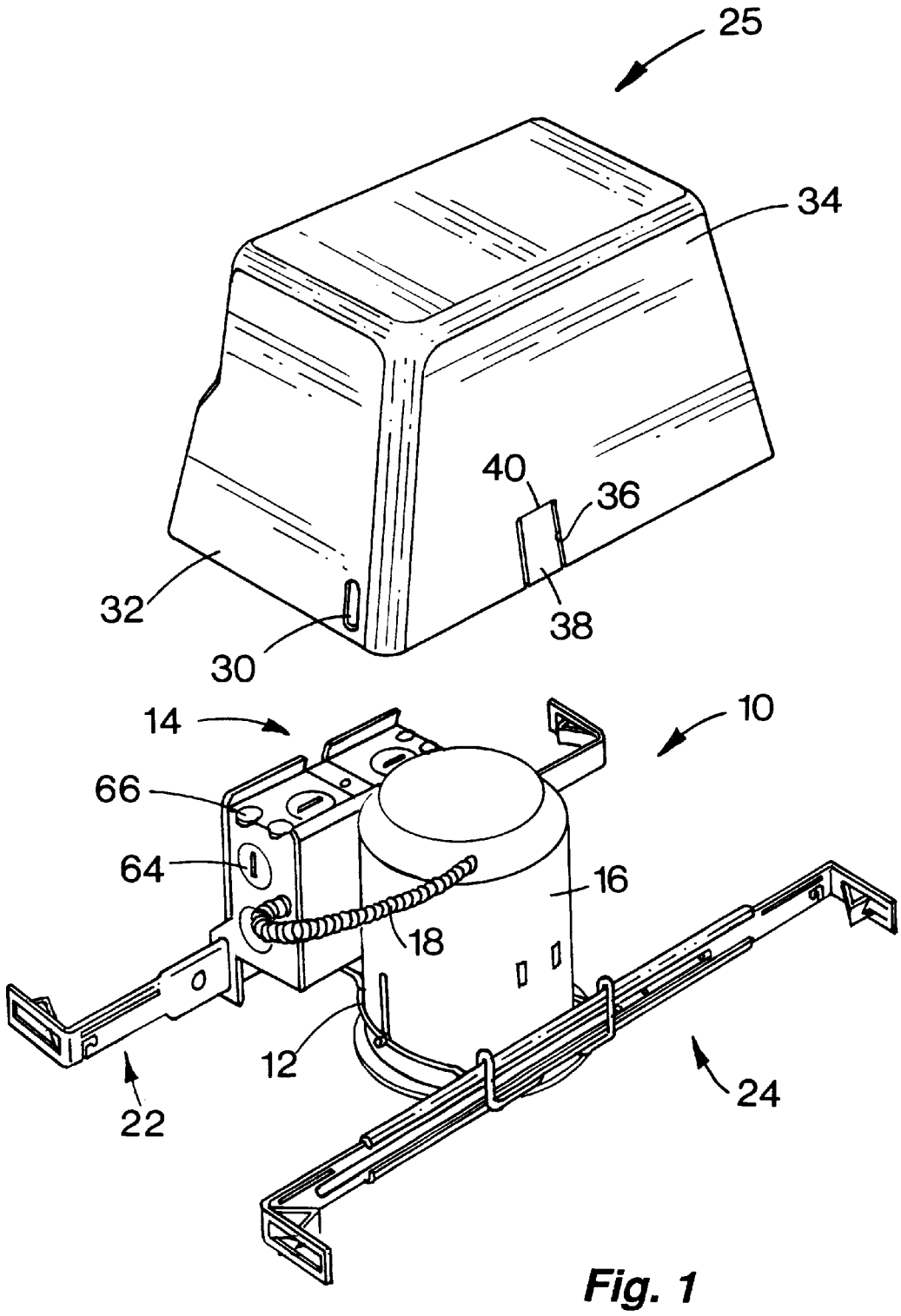
FIG. 1 is an exploded assembly view illustrating a typical recessed downlighting fixture onto which an insulation shield shown in the drawing can be mounted in order to realize the objectives and advantages of the invention.
Figure 2:
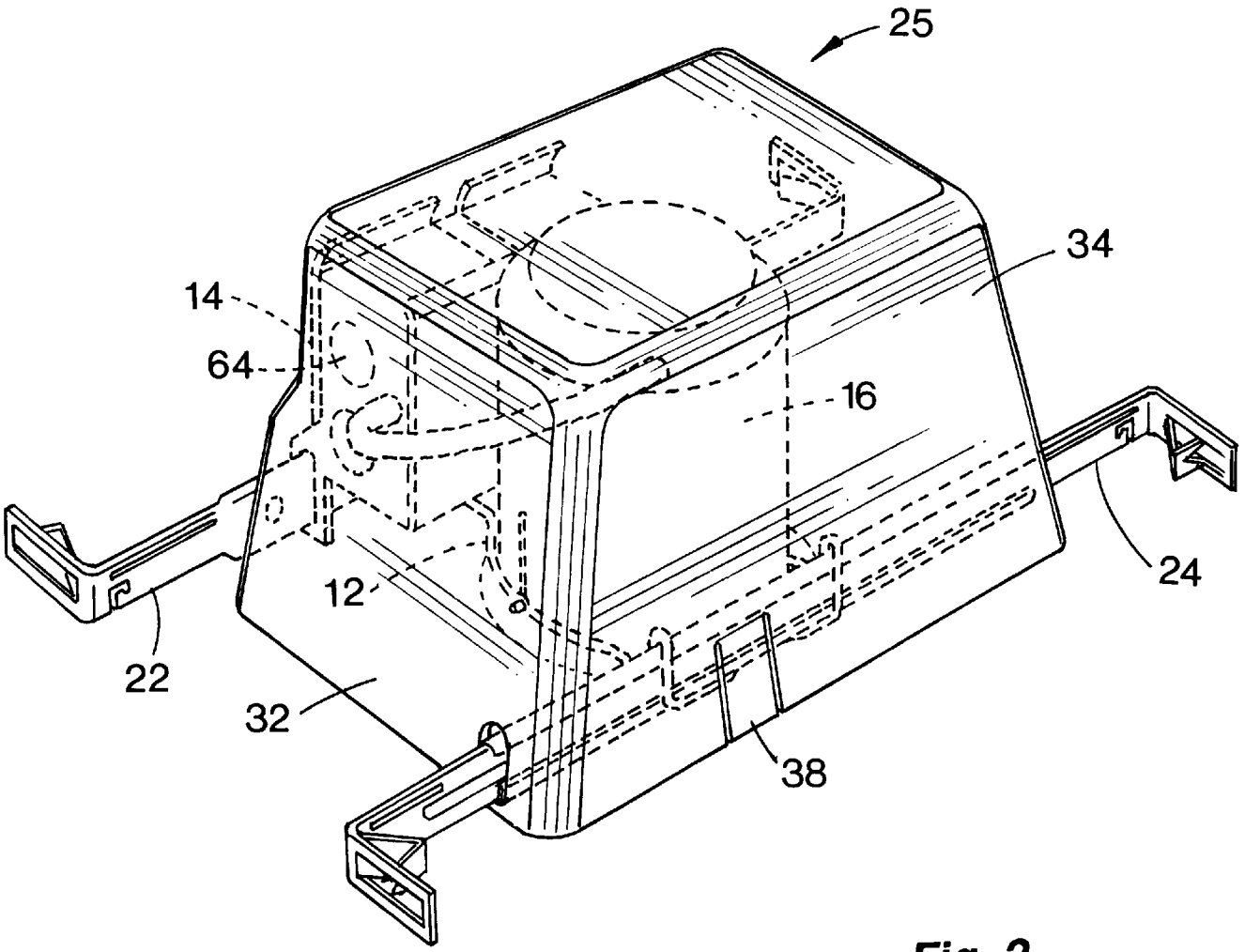
FIG. 2 is a perspective view of the elements of FIG. 1 in an assembled relationship.
Figure 3:
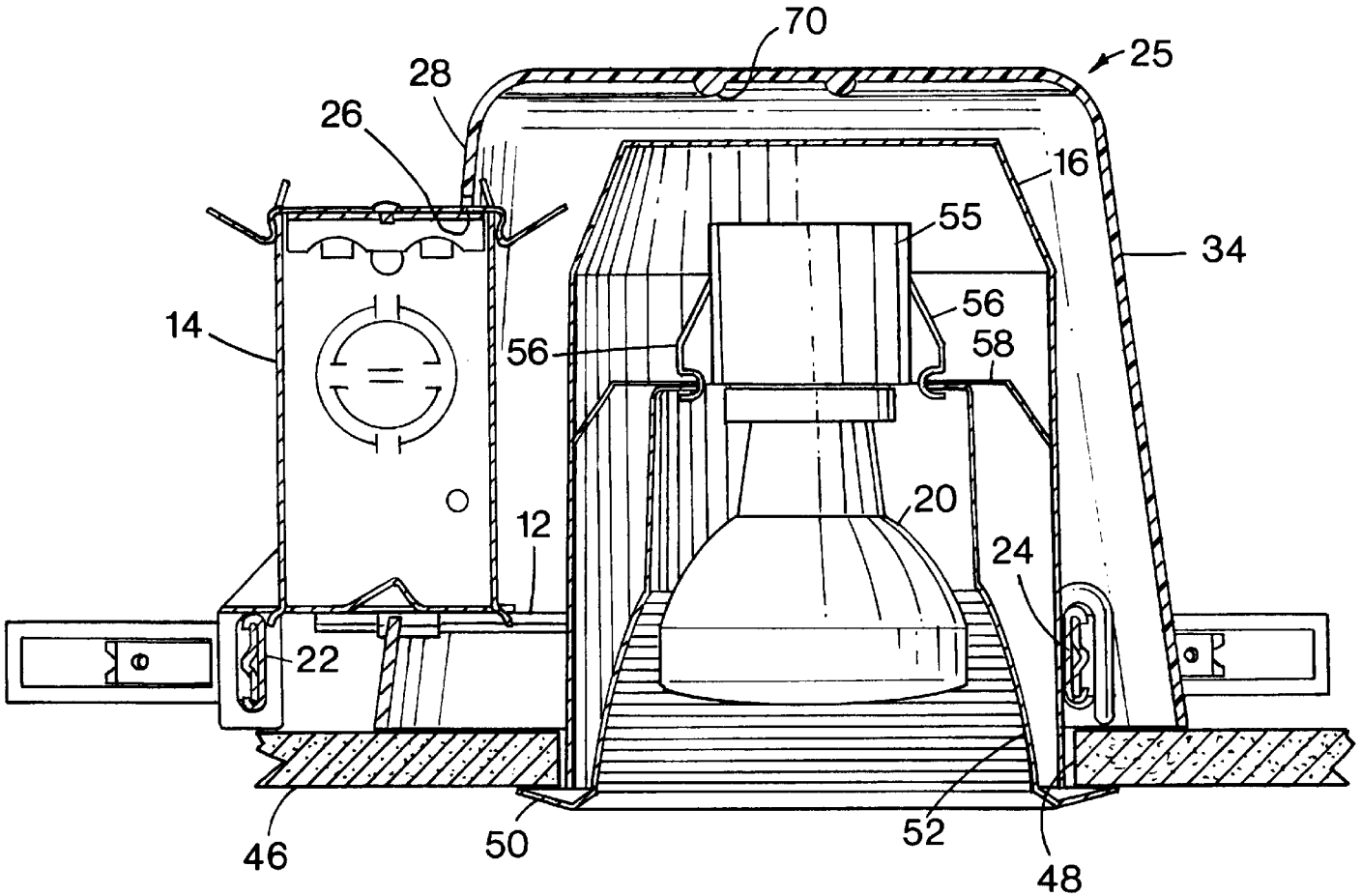
FIG. 3 is a side elevational view in partial section of the assembly of FIG. 2.

Referring now to the drawings and particularly to FIGS. 1 and 2, a recessed lighting fixture is seen generally at 10, the fixture 10 being a fixture which is particularly suitable for use in obtaining the advantages and benefits of the present invention. The fixture 10 can be essentially identical to that recessed lighting fixture described in U.S. Pat. No. 5,690,423, the disclosure thereof being incorporated hereinto as aforesaid. The fixture 10 comprises a wire frame pan 12 which mounts a junction box 14 and can 16 which are connected by a standard conduit 18 through which insulated wiring (not shown) extends from the junction box to the interior of the can 16 to provide power to a lamp 20 (as seen in FIG. 3 inter alia). The lamp 20 is mounted within the can 16 in a manner which will be described hereinafter.

The wire frame pan 12 is mounted by hanger bar assemblies 22 and 24 between joists (not shown) above a ceiling (shown in FIG. 3) in which an opening is formed. The bar hanger assemblies 22 and 24 can be similar to or identical to the bar hanger assemblies previously referred to herein, it being possible for the bar hanger assemblies 22 and 24 to take a variety of other forms consistent with use of the present invention.

Figure 4:
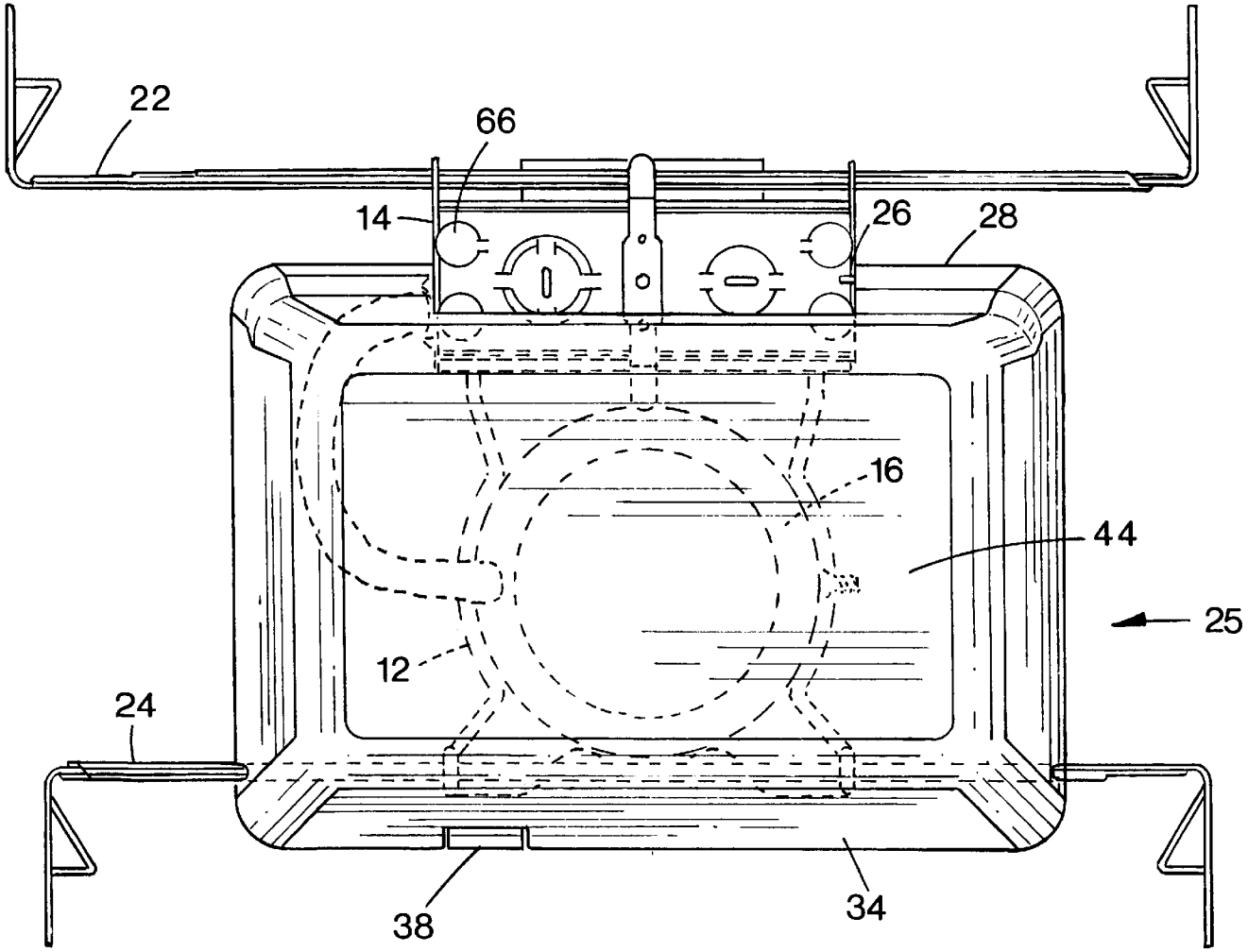
FIG. 4 is a plan view of the assembly of FIG. 2.
Figure 5:
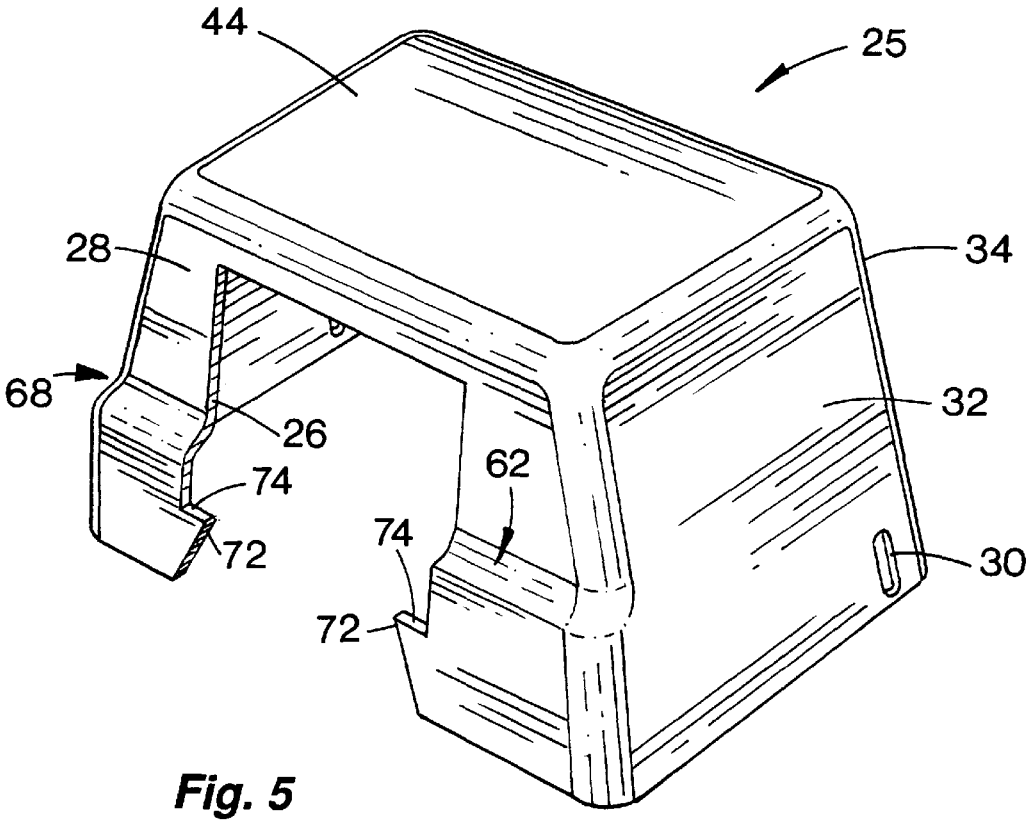
FIG. 5 is a perspective view of the insulation shield of the invention.

In FIG. 1, the recessed lighting fixture 10 is seen to be surmounted in assembly relation by an insulation shield 25 which is preferably formed of a polymeric material such as polycarbonate or glass-filled polypropylene (30% fill), the material employed to form the insulation shield 25 being preferably polymeric for toughness and rigidity as well as for flame resistance,low weight and moldability. The insulation shield 25 is mounted to the fixture 10 by bringing the shield 25 into covering relation with the fixture 10 such that an opening 26 formed in rear wall 28 of the shield 25 engages upper and side walls of the junction box 14 as best seen in FIGS. 3, 4 and 5. Further, the hanger bar assembly 24 is extended through aligned slots 30 formed in respective side walls 32 of the shield 25 to positively mount the shield 25 to the fixture 10. The slots 30 can be configured to be at least partially open at lower ends so that the hanger bar assembly 24 can be snapped into the slots 30 in an alternate embodiment of the invention.

Front wall 34 of the shield 25 is provided with a rectangular notch 36 having a closure flap 38 mounted essentially thereover by means of a living hinge 40, the flap 38 and the hinge 40 being integrally formed with the shield 25 in a preferred embodiment of the invention. The flap 38 can be displaced upwardly by pivoting the flap 38 about the hinge 40 to expose a clip (not shown) which mounts to a portion of the wire frame pan 12 to lock the bar hanger assembly 24 in place once slide and track elements of the bar hanger assembly 24 have been extended to a proper length for mounting to joists or the like. The clip is described in U.S. patent application Ser. No. 09/126,690, filed Jul. 30, 1998, for "Bar Hanger Clip" and assigned to the present assignee, the disclosure of this patent application being incorporated hereinto by reference.

As seen in the drawings and particularly in FIGS. 5 through 8, the insulation shield 25 comprises a box-like structure formed of the front and rear walls 34 and 28 and side walls 32 as aforesaid. Completing the structure of the shield 25 is a top wall 44 which joins at perimetric edges with the respective walls previously mentioned, the lower face of the insulation shield 25 being open in order to receive the fixture 10 thereinto. The volume and dimensions of the insulation shield 25 are chosen empirically in order to hold insulation desired distances from exterior surfaces of the can 16 in particular since the can 16 houses the heat generating lamp 20. Since the fixture 10 having the insulation shield 25 mounted thereto as seen in FIG. 2 is normally buried in insulation and in an insulation contact (I.C.) application, the volume within the insulation shield 25 must be empirically selected along with the dimensions as aforesaid to provide the ability to utilize lamping of increased wattage than would be possible if the recessed lighting fixture 10 alone was buried in insulation as is the case in I.C. applications in which the lighting fixture 10 would be normally utilized. The insulation shield 25 thus functions to allow efficient dissipation of heat from the fixture 10 which heat dissipation efficiency allows the use of lamping of a wattage to produce greater illumination in an I.C. application than would be possible through use of the recessed lighting fixture 10 alone. The recessed lighting fixture 10 is therefore converted through use of the insulation shield 25 to a "premium" or super fixture useful in I.C. applications to provide improved illumination, that is, greater light output.

The volume defined by the insulation shield 25 is chosen empirically depending upon fixture size and the increased wattage of lamping used when the insulation shield 25 is employed with the given lighting fixture. The effects of the trim are also considered as will be described hereinafter.

While the lower open face of the insulation shield 25 as seen in FIG. 2 appears to be open to ambient, in an insulation situation such as is seen in FIG. 3, ceiling 46 essentially covers the open face of the shield 25 and effectively encloses the interior of said shield 25. An opening 48 formed in the ceiling 46 typically has lower portions of the can 16 received thereinto, a flange 50 of finishing trim 52 typically abutting lower surfaces of the ceiling 46 adjacent the opening 48 to provide a finished appearance. The trim 52 is conventional in structure and function and typically mounts a conventional socket 55 by attachment of socket spring clip 56 as is also conventional. The trim 52 is held within the can 16 by means of clips 58 which can be of the type disclosed in U.S. Pat. No. 5,707,143, the disclosure of which is incorporated hereinto by reference as aforesaid. U.S. Pat. No. 5,707,143 also discusses in detail finishing or reflector trim such as the trim 52, the function of the trim 52 and the structural relationship of the trim 52 with structure contained within the can 16. The lamp 20 is mounted directly by socket 55 in a known manner, power being supplied to the lamp 20 by means of electrical wiring (not shown) extending to and through the socket 55, the wiring extending from the junction box 14 through the conduit 18 in a conventional manner.

The can 16 can take the form of an I.C. rated can or can take the form of an I.C./non-I.C. can such as is described in U.S. patent application Ser. No. 08/686,669, filed Jul. 26, 1996, the disclosure of which is incorporated hereinto by reference as aforesaid. Regardless of the can 16 employed in the fixture 10, the lamp 20 can take the form of a lamp having a higher wattage when the insulation shield 25 is used with the fixture 10. A thermal protector (not shown) of appropriate rating is mounted within the can 16 as described in U.S. Pat. No. 5,836,678 and functions in the manner described in the aforesaid Patent when the can 16 is an I.C./non-I.C. can. Similarly, the thermal protector would function in a conventional manner in the event that the can 16 is an I.C. rated can. As an example, the thermal protector would typically be rated for 120° C. The appropriate rating of a thermal protector so used is empirically determined.

Referring now to FIGS. 1 through 4, mounting of the insulation shield 25 to the lighting fixture 10 allows the junction box 14 to fit within the opening 26 formed in the rear wall 28 of the shield 25, a portion of the junction box 14 residing within the interior of the insulation shield 25 with major portions of the junction box 14 being disposed externally of the insulation shield 25. It is preferred to form a first end of the rear wall 28 with a curvature at 62 (see FIG. 5 inter alia) to allow access to knock-out 64 and to Romex opening 66. Similarly, the other end of the shield 25 is formed with a curvature at 68 in order to allow access to the other side of the junction box 14. It is to be understood that the insulation shield 25 as shown in the drawings is configured in order to accommodate a known lighting fixture 10 having a standard junction box 14. It should be appreciated that the junction box could be designed such that the curvatures at 62 and 68 could be eliminated without encountering difficulty in gaining access to the interior of the junction box.

When using the insulation shield 25 with the particular recessed lighting fixture 10 as seen in the drawings, it is to be noted that the bar hanger assembly 22 is mounted by an extension of the junction box 14 as is described in U.S. Pat. No. 5,690,423. The junction box 14 illustrated is configured with a removable access panel retained by a clip as is also described in U.S. Pat. No. 5,690,423.

Figure 8:
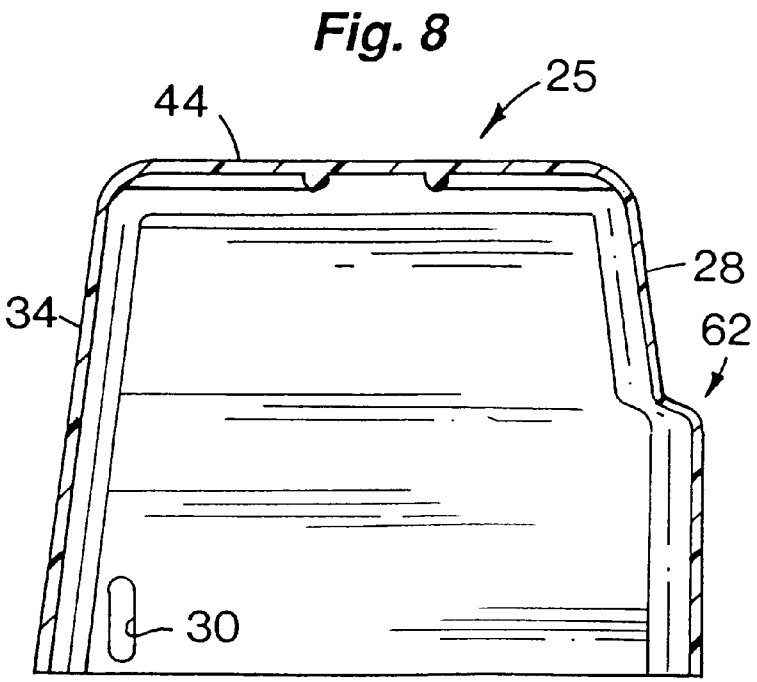
FIG. 8 is a section taken along lines 8—8 of FIG. 6.
Figure 7:
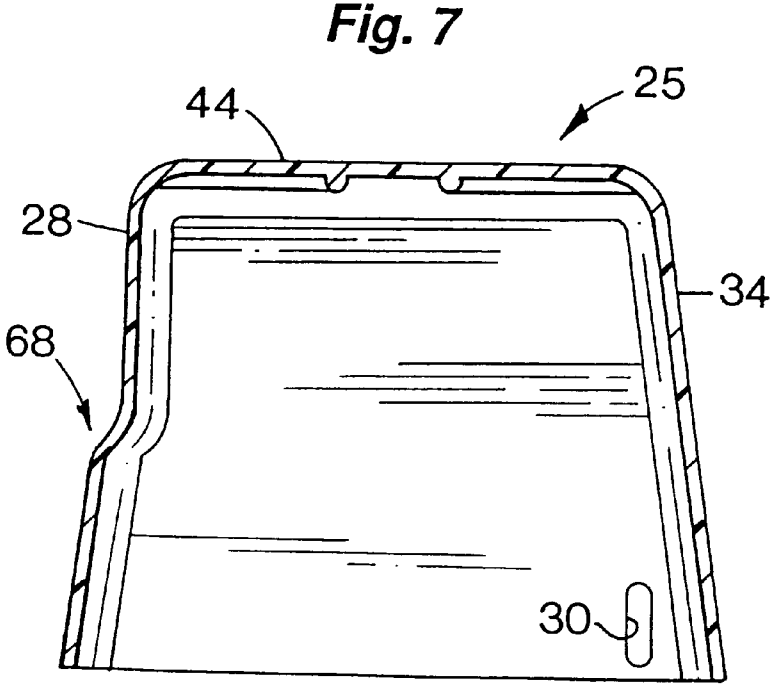
FIG. 7 is a section taken along lines 7—7 of FIG. 6.

As is best seen in FIGS. 3, 7 and 8, runners 70 formed integrally on lower wall surfaces of the top wall 44 are provided to facilitate manufacture of the insulation shield 25 and are primarily a manufacturing expedient which facilitates plastic flow within a mold. The runners 70 also act to increase strength of the top wall 44 and thus the shield 25 itself.

Figure 6:
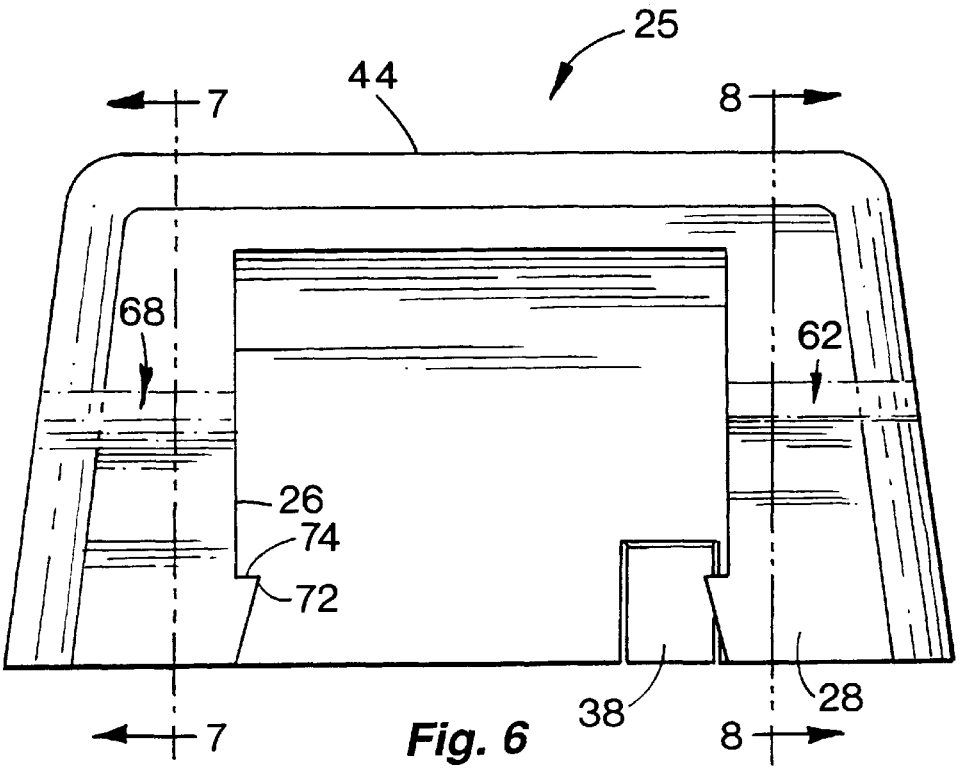
FIG. 6 is a rear elevational view of the insulation shield of the invention.
Figure 9:
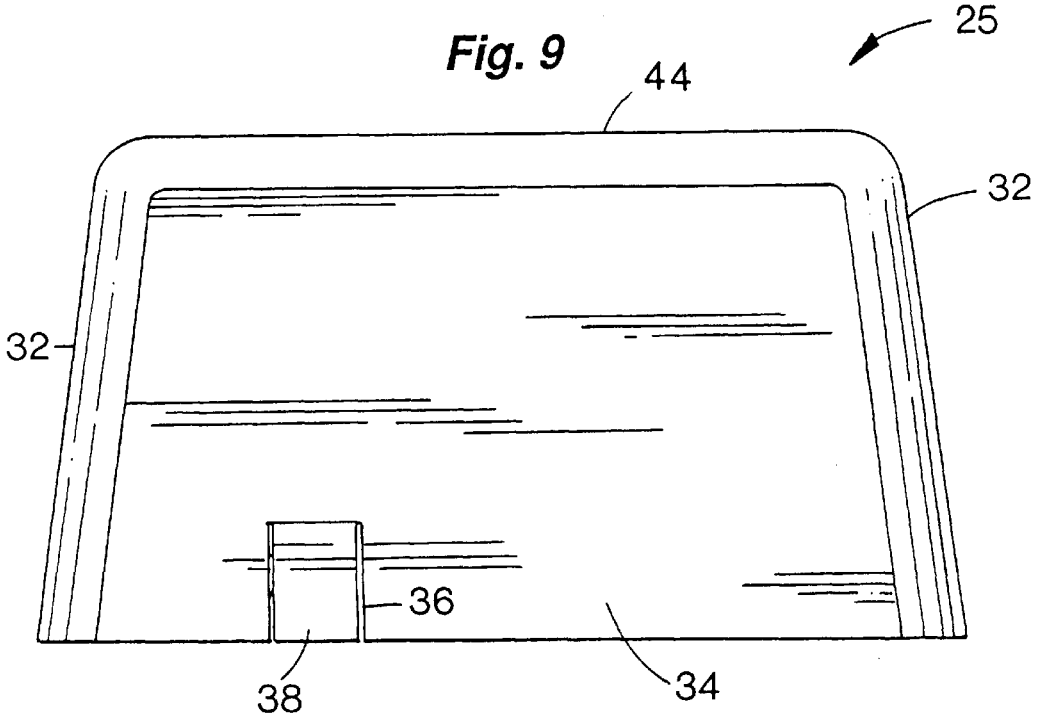
FIG. 9 is a front elevational view of the insulation shield illustrating an opening having a flap-like element covering the opening, the opening being employed to accommodate a clip mountable to a bar hanger assembly of the fixture so that such clip can be used to hold the bar hanger assembly in a desired extension.

As is best seen in FIGS. 5 and 6, the opening 26 formed in the rear wall 28 is formed with angular projections 72 which extend from lowermost corners of the opening 26 and into the opening to form ledges 74 which are respectively received beneath lower side portions of the junction box 14 to facilitate positive mounting of the insulation shield 25 to the fixture 10. FIG. 9 best illustrates the flap 38 formed in surmounting relation to the notch 36 which notch 36 allows access to the clip as aforesaid and having the function described hereinabove. A second clip can be mounted to the bar hanger assembly 22, such as to a slot formed in the junction box 14 as is described in pending U.S. patent application Ser. No. 09/126,690, filed Jul. 30, 1998, and incorporated hereinto as aforesaid.

Upper corners of the insulation shield 25 are preferably rounded as shown in the drawings and the junctures between the top wall 44 and the rear and front walls 28 and 34 as well as the side walls 32 are preferably rounded in order to provide a pleasing appearance and to facilitate manufacture.

Figure 11:
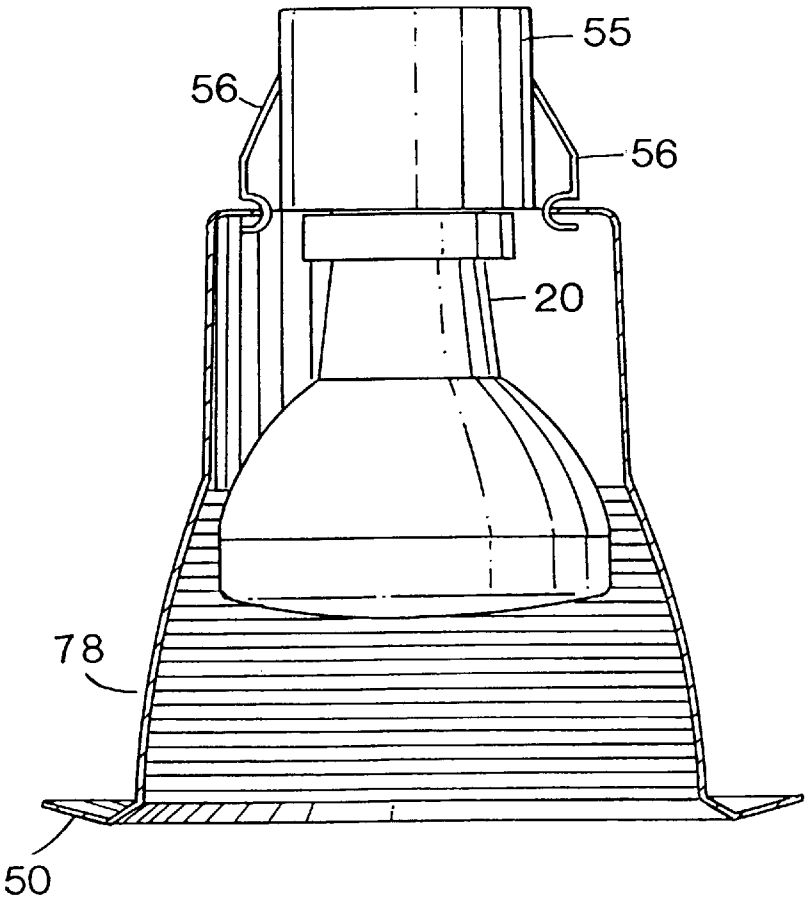
Figure 10:
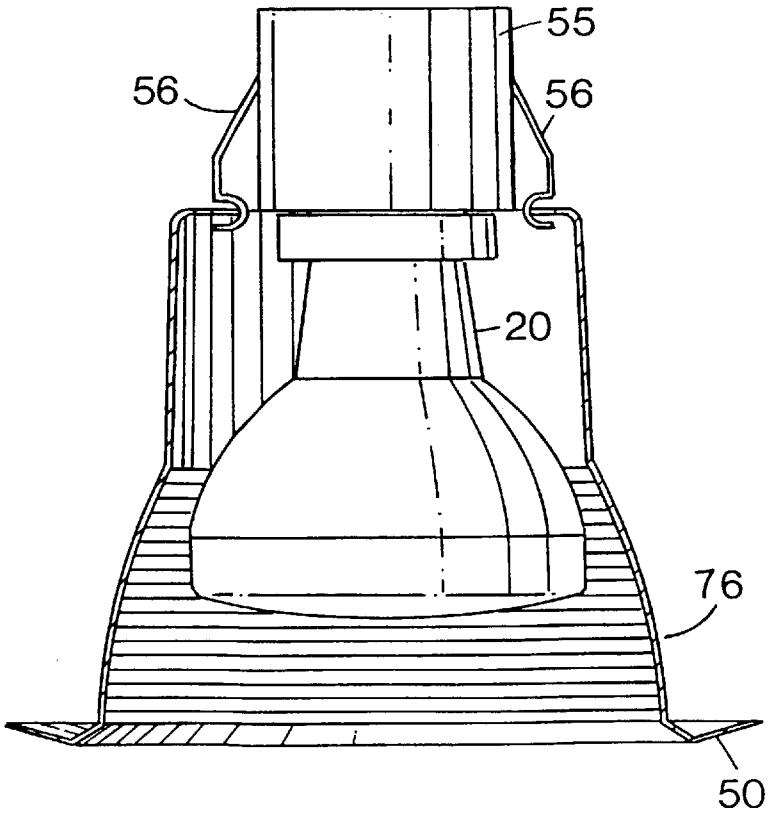
FIG. 10 is a side elevational view of an I.C./non-I.C. rated finishing trim; and, FIG. 11 is a side elevational view of a non-I.C. finishing trim which is convertible to use as an I.C. trim through use of the present insulation shield.

Referring again to FIG. 3 as well as to FIGS. 10 and 11, the finishing trim 52 seen in FIG. 3 can take the form of a trim such as trim 76 of FIG. 10 or trim 78 such as is seen in FIG. 11. The trim 76 and 78 are seen to be provided with sockets such as the socket 55, the sockets mounting appropriate lamping. The trim 76 when used in a fixture such as the fixture 10 of FIG. 1 without the insulation shield 25 could be used with an I.C./non-I.C. rated can to use a 35 watt PAR 20 or 30 watt R20 lamp in an I.C. application or a 50 watt PAR 20 or a 75 watt R20 lamp in a non-I.C. application. In other words, the trim 76 is both an I.C. and a non-I.C. rated trim. The trim 76 is conventional in the art and merely representative of a large number of trim which are commecially available. The trim 78 of FIG. 11 when used in the fixture 10 of FIG. 1 without the insulation shield 25 is not I.C. rated and could not be used in an I.C. application. However, the trim 78 in a non-I.C. application could use a 50 watt PAR 20 lamp or a 75 watt R20 lamp.

In the assembled fixture of FIG. 2 which includes the insulation shield 25, the trim 76 of FIG. 10 would allow use in an I.C. application of a 50 watt PAR 20 lamp or a 50 watt R20 lamp as compared to 35 watt and 30 watt lamping noted above for an I.C. application. The trim 78 of FIG. 11 used with the fixture 10 of FIG. 2 having the insulation shield 25 mounted thereto could use lamping in an I.C. application of 35 watt PAR 20 type or 30 watt R20 type. Without the insulation shield 25, the recessed lighting fixture 10 using the trim 78 of FIG. 11 would not be usable in an insulation contact application but would be usable in an insulation contact application with the insulation shield 25 mounted thereto. All presently available trims could thus be used in a lighting fixture such as the fixture 10 as long as the insulation shield 25 is mounted thereto as described herein. Even finishing trims which were previously not rated for I.C. applications could be used in I.C. applications with lamping of similar wattage to that employed for I.C./non-I.C. trims usable in the fixture 10 alone. Accordingly, products such as the fixture 10 presently offered in the marketplace have expanded utility in terms of the ability to utilize lamping of higher wattages. Further, all trims used with such fixtures can be used in I.C. applications when the insulation shield 25 is used. It is also to be understood that the wattage of lamping in a non-insulation contact application could also be increased when using the shield 25.

An insulation shield according to the invention and useful with the lamp wattages and trim discussed above can have varying dimensions based upon exigencies involving fixture configuration and the like. For the fixture shown and which fixture includes a can having a height of approximately 5.19 inches and a diameter of approximately 4.0 inches, the shield 25 would have dimensions of approximately 5.25 inches in height, approximately 9.5 inches in length and approximately 6.5 inches in width, the shield 25 having an interior volume of approximately 300 cubic inches. The wall thickness of the shield 25 is conveniently taken to be approximately 0.07 inch. In typical installations, the top of the can 16 is spaced from interior wall surfaces of the shield 25 by less than 0.5 inch. Fixtures of larger size will, of course, require shield structures of greater dimensions, such larger fixtures having a greater range of lamp wattages available for use, these larger fixtures thus finding utility to a greater degree in non-I.C. installations.

While the insulation shield 25 of the invention has been described explicitly relative to a particular recessed lighting fixture 10, it is to be understood that the shield 25 can be embodied in forms other than has been expressly shown. In particular, the shield 25 can be formed of materials other than the polymeric materials which are preferred, suitable shields being formable of metals and the like. Similarly, other structure herein explicitly described can be configured other than as expressly shown and described herein. Accordingly, it can be readily understood in view of the particular embodiments of the invention which are expressly described hereinabove that the invention can be formed in a wide variety of configurations without departing from the intended scope of the invention, the scope of the invention being defined by the recitations of the appended claims.

What is claimed is:

1. In a recessed lighting fixture assembly having a pan supporting a lamp housing, the lamp housing either being rated for use with lamping of a given wattage in an insulation contact application and/or a non-insulation contact application, the improvement comprising an insulation shield mountable to the fixture assembly and preventing contact between at least portions of the lamp housing and at least portions of insulation surrounding the fixture assembly in said insulation contact application and/or said non-insulation contact application, the insulation shield maintaining the insulation from said portions of the lamp housing at spacings thereabout sufficiently to allow use of increased lamp wattages, the insulation shield being unitary in structure and being molded from a material amenable to formation of the insulation shield as a single one-piece structural element, the shield comprising a housing having a top wall, a front wall, a rear wall, and opposing side walls formed into a unitary structure, the front wall, rear wall, and side walls depending at angles from the top wall to form a box-like structure open on a lowermost face thereof and wherein the rear wall of the housing is formed arcuately in at least one location thereof to allow access to and use of at least portions of the junction box from exteriorly of the housing.

2. In the fixture assembly of claim 1 wherein the fixture assembly further comprises a junction box mounted to the fixture assembly and the rear wall has an opening formed therein, at least a portion of the junction box being disposed interiorly of the housing and at least another portion of the junction box being disposed exteriorly of the housing to allow at least limited access to the interior of the junction box from exteriorly of the housing, and means formed integrally with the rear wall at peripheral portions of the opening for engaging at least portions of the junction box to facilitate mounting of the insulation shield to the fixture.

3. In the fixture assembly of claim 1 wherein the rear wall of the housing is formed arcuately in at least one location thereof to allow access to and use of at least portions of the junction box from exteriorly of the housing.

4. In the fixture assembly of claim 1 wherein the front wall is formed with a notch therein, the notch having a flap disposed in proximity to the notch, the flap being mounted for movement toward and away from the notch to allow access to the interior of the housing.

5. In the fixture assembly of claim 4 wherein the side walls are formed with aligned slots and the fixture assembly further comprises at least one bar hanger assembly mounted to the fixture assembly, the bar hanger assembly extending through the aligned slots in the side walls of the housing to mount the housing to the fixture assembly.

6. In the fixture assembly of claim 2 wherein wall portions of the rear wall define lowermost portions of the opening formed in the rear wall and project into the opening to form the ledges onto which portions of the junction box seat for mounting of the insulation shield to the fixture assembly.

7. In the fixture assembly of claim 1 and further comprising a finishing trim rated for non-insulation contact applications when used with the fixture assembly without the housing mounted thereto and rated for insulation contact applications when used with the housing.

8. In the fixture assembly of claim 1 wherein the housing is formed of a polymeric material.

9. In the fixture assembly of claim 1 and further comprising a thermal protector disposed in operative relation to the lamp housing.

10. In the fixture of claim 2 wherein the engaging means comprise spaced apart wall portions of the rear wall, which wall portions project into the opening from either side of said opening to form respective ledges which engage portions of the junction box, substantial remaining portions of the junction box fitting within remaining portions of the opening.

11. In the fixture of claim 5 wherein only one bar hanger assembly is mounted by the insulation shield.

12. In the fixture of claim 1 wherein at least major portions of the pan are disposed interiorly of the insulation shield.

13. A lighting fixture assembly rated at least for insulation contact applications with first lamping having wattages of first given values, the fixture assembly comprising a support element and a lamp housing, the lamp housing mounting the first lamping in an insulation contact application wherein insulation contacts at least portions of the lamp housing, the fixture assembly further comprising a unitary insulation shield mounted to the fixture assembly for converting the fixture assembly to use in an insulation contact application with second lamping having wattages of second, increased values relative to said wattages of said first given values of the first lamping, the fixture assembly being useful at least in an insulation contact application while mounting said insulation shield to produce an increased lighting output, the insulation shield being formed of a material amenable to molding of the shield into a single, one-piece structural element, the insulation shield comprising a housing mountable to the fixture assembly for preventing contact between at least portions of the lamp housing and insulation surrounding at least portions of the fixture assembly, the housing maintaining the insulation from said portions of the lamp housing at spacings thereabout sufficient to allow use of the second lamping in an insulation contact application, the housing having a top wall, a front wall, a rear wall and opposing side walls, the front wall, rear wall and side walls depending from the top wall to form a box-like structure open on a lowermost face thereof, the fixture assembly further comprising a junction box mounted to the fixture assembly and wherein the rear wall has an opening formed therein, at least a portion of the junction box being disposed interiorly of the housing and fitting within said opening, at least another portion of the junction box being disposed exteriorly of the housing to allow at least limited access to the interior of the junction box, the rear wall of the housing being formed arcuately in at least one location thereof to allow access to and use of junction box structure from exteriorly of the housing.

14. The lighting fixture assembly of claim 13 wherein the insulation shield comprises a housing mountable to the fixture assembly for preventing contact between at least portions of the lamp housing and insulation surrounding at least portions of the fixture assembly, the housing maintaining the insulation from said portions of the lamp housing at spacings thereabout sufficient to allow use of the second lamping in an insulation contact application.

15. The lighting fixture assembly of claim 14 wherein the housing has a top wall, a front wall, a rear wall and opposing side walls, the front wall, rear wall and side walls depending from the top wall to form a box-like structure open on a lowermost face thereof.

16. The lighting fixture assembly of claim 15 wherein the fixture assembly further comprises a junction box mounted to the fixture assembly and wherein the rear wall has an opening formed therein, at least a portion of the junction box being disposed interiorly of the housing and fitting within said opening, at least another portion of the junction box being disposed exteriorly of the housing to allow at least limited access to the interior of the junction box.

17. The lighting fixture assembly of claim 15 wherein the rear wall of the housing is formed arcuately in at least one location thereof to allow access to and use of junction box structure from exteriorly of the housing.

18. The lighting fixture assembly of claim 15 wherein the front wall is formed with a notch therein, the notch having a flap disposed over the notch, the flap being mounted for movement toward and away from the notch to allow access to the interior of the housing.

19. The lighting fixture assembly of claim 18 wherein the side walls are formed with aligned slots and the fixture assembly further comprises at least one bar hanger assembly mounted to the fixture assembly, the bar hanger assembly extending through the aligned slots in the side walls to mount the housing to the fixture assembly.

20. The lighting fixture assembly of claim 16 wherein wall portions of the rear wall defining lowermost portions of the opening formed in the rear wall project into the opening to form ledges onto which portions of the junction box seat for support of the fixture assembly.

21. The lighting fixture assembly of claim 15 and further comprising a finishing trim rated for non-insulation contact applications when used with the fixture assembly without the housing mounted thereto and rated for insulation contact applications when used with the housing.

22. The lighting fixture assembly of claim 14 wherein the housing is formed of a polymeric material.

23. The lighting fixture of claim 13 wherein the lamp housing comprises an I.C. type/non-I.C. type can.

24. The lighting fixture of claim 13 wherein at least major portions of the support element are disposed interiorly of the insulation shield.

25. The lighting fixture assembly of claim 13 wherein the front wall is formed with a notch therein, the notch having a flap disposed over the notch, the flap being mounted for movement toward and away from the notch to allow access to the interior of the housing.

26. The lighting fixture assembly of claim 25 wherein the side walls are formed with aligned slots and the fixture assembly further comprises at least one bar hanger assembly mounted to the fixture assembly, the bar hanger assembly extending through the aligned slots in the side walls to mount the housing to the fixture assembly.

27. The lighting fixture assembly of claim 13 wherein wall portions of the rear wall definining lowermost portions of the opening formed in the rear wall project into the opening to form ledges onto which portions of the junction box seat for support of the fixture assembly.

28. The lighting fixture assembly of claim 13 and further comprising a finishing trim rated for non-insulation contact applications when used with the fixture assembly without the housing mounted thereto and rated for insulation contact applications when used with the housing.

29. The lighting fixture of claim 13 wherein the housing is formed of a polymeric material.

30. In a recessed lighting fixture assembly having a pan supporting a lamp housing, the lamp housing either being rated for use with lamping of a given wattage in an insulation contact application and/or a non-insulation contact application, the improvement comprising an insulation shield mountable to the fixture assembly and preventing contact between at least portions of the lamp housing and at least portions of insulation surrounding the fixture assembly in said insulation contact application and/or said non-insulation contact application, the insulation shield maintaining the insulation from said portions of the lamp housing at spacings thereabout sufficiently to allow use of increased lamp wattages, the insulation shield being unitary in structure and being molded from a material amenable to formation of the insulation shield as a single one-piece structural element, the shield comprising a housing having a top wall, a front wall, a rear wall, and opposing side walls formed into a unitary structure, the front wall, rear wall, and side walls depending at angles from the top wall to form a box-like structure open on a lowermost face thereof, the front wall being formed with a notch therein, the notch having a flap disposed in proximity to the notch, the flap being mounted for movement toward and away from the notch to allow access to the interior of the housing.

31. In the fixture assembly of claim 30 wherein the fixture assembly further comprises a junction box mounted to the fixture assembly and the rear wall has an opening formed therein, at least a portion of the junction box being disposed interiorly of the housing and at least another portion of the junction box being disposed exteriorly of the housing to allow at least limited access to the interior of the junction box from exteriorly of the housing.

32. In the fixture assembly of claim 30 wherein the rear wall of the housing is formed arcuately in at least one location thereof to allow access to and use of at least portions of the junction box from exteriorly of the housing.

33. In the fixture assembly of claim 30 wherein the side walls are formed with aligned slots and the fixture assembly further comprises at least one bar hanger assembly mounted to the fixture assembly, the bar hanger assembly extending through the aligned slots in the side walls of the housing to mount the housing to the fixture assembly.

34. In the fixture assembly of claim 31 wherein wall portions of the rear wall define lowermost portions of the opening formed in the rear wall and project into the opening to form the ledges onto which portions of the junction box seat for mounting of the insulation shield to the fixture assembly.

35. In the fixture assembly of claim 30 and further comprising a finishing trim rated for non-insulation contact applications when used with the fixture assembly without the housing mounted thereto and rated for insulation contact applications when used with the housing.

36. In the fixture assembly of claim 30 wherein the housing is formed of a polymeric material.

37. In the fixture assembly of claim 30 and further comprising a thermal protector disposed in operative relation to the lamp housing.

38. A lighting fixture assembly rated at least for insulation contact applications with first lamping having wattages of first given values, the fixture assembly comprising a support element and a lamp housing, the lamp housing mounting the first lamping in an insulation contact application wherein insulation contacts at least portions of the lamp housing, the fixture assembly further comprising a unitary insulation shield mounted to the fixture assembly for converting the fixture assembly to use in an insulation contact application with second lamping having wattages of second, increased values relative to said wattages of said first given values of the first lamping, the fixture assembly being useful at least in an insulation contact application while mounting said insulation shield to produce an increased lighting output, the insulation shield being formed of a material amenable to molding of the shield into a single, one-piece structural element, the insulation shield comprising a housing mountable to the fixture assembly for preventing contact between at least portions of the lamp housing and insulation surrounding at least portions of the fixture assembly, the housing maintaining the insulation from said portions of the lamp housing at spacings thereabout sufficient to allow use of the second lamping in an insulation contact application, the housing having a top wall, a front wall, a rear wall and opposing side walls, the front wall, rear wall and side walls depending from the top wall to form a box-like structure open on a lowermost face thereof, the front wall being formed with a notch therein, the notch having a flap disposed over the notch, the flap being mounted for movement toward and away from the notch to allow access to the interior of the housing.

39. The lighting fixture assembly of claim 38 wherein the fixture assembly further comprises a junction box mounted to the fixture assembly and wherein the rear wall has an opening formed therein, at least portions of the junction box being disposed interiorly of the housing and fitting within said opening, at least another portion of the junction box being disposed exteriorly of the housing to allow at least limited access to the interior of the junction box.

40. The lighting fixture assembly of claim 39 wherein wall portions of the rear wall defining lowermost portions of the opening formed in the rear wall project into the opening to form ledges onto which portions of the junction box seat for support of the fixture assembly.

41. The lighting fixture assembly of claim 38 wherein the rear wall of the housing is formed arcuately in at least one location thereof to allow access to and use of junction box structure from exteriorly of the housing.

42. The lighting fixture assembly of claim 38 wherein the side walls are formed with aligned slots and the fixture assembly further comprises at least one bar hanger assembly mounted to the fixture, the bar hanger assembly extending through the aligned slots in the side walls to mount the housing to the fixture assembly.

43. The lighting fixture assembly of claim 38 and further comprising a finishing trim rated for non-insulation contact applications when used with the fixture assembly without the housing mounted thereto and rated for insulation contact applications when used with the housing.

44. The lighting fixture assembly of claim 38 wherein the housing is formed of a polymeric material.

* * * * *